US011377847B2

(12) United States Patent
Naim Ibrahim

(10) Patent No.: US 11,377,847 B2
(45) Date of Patent: Jul. 5, 2022

(54) UNITIZED CURTAIN WALL SYSTEM FOR PASSIVE HOUSE STANDARD

(71) Applicant: Gamma Windows And Walls International Inc., Concord (CA)

(72) Inventor: Ehab Naim Ibrahim, Brampton (CA)

(73) Assignee: Gamma Windows And Walls International Inc., Concord (CA)

( * ) Notice: Subject to any disclaimer, the term of this patent is extended or adjusted under 35 U.S.C. 154(b) by 0 days.

(21) Appl. No.: 16/913,344

(22) Filed: Jun. 26, 2020

(65) Prior Publication Data

US 2021/0404181 A1 Dec. 30, 2021

(51) Int. Cl.
*E04B 2/96* (2006.01)
*E04B 1/68* (2006.01)

(52) U.S. Cl.
CPC ..... *E04B 2/96* (2013.01); *E04B 1/68* (2013.01); *E04B 1/6812* (2013.01)

(58) Field of Classification Search
CPC ..... E04B 2/96; E04B 1/68; E04B 1/6812; E04B 2/965; E04B 2/967; E04B 1/62
See application file for complete search history.

(56) References Cited

U.S. PATENT DOCUMENTS 9,752,319 B1 * 9/2017 LeVan ..... E04B 2/885
2019/0100913 A1 * 4/2019 Doyon ..... E04B 2/967

FOREIGN PATENT DOCUMENTS

EP 0303451 A1 * 2/1989 ..... E04B 2/96

* cited by examiner

*Primary Examiner* — Patrick J Maestri
(74) *Attorney, Agent, or Firm* — Dickinson Wright LLP; Yuri Chumak

(57) ABSTRACT

A unitized curtain wall system includes pre-assembled, pre-glazed aluminum framed curtain wall units. Vertical mullion components and top and bottom horizontal rail components interconnect adjacent curtain wall panels. The curtain wall units are suspended from one or more upper anchors installed on an upper floor slab. The bottom horizontal rail components are engaged with top horizontal rail components of adjacent, lower curtain wall units forming a continuous beam scheme for vertical mullion components and configured to accept lateral loads. The gravity loads of curtain wall units are supported by one or more floor anchors. Organic shaped insulating forms are disposed laterally between top and bottom horizontal rail components of adjacent curtain wall panels. The forms are compressible to permit flexing vertical movement of the curtain wall units while reducing air movement in a horizontal cavity formed between the top and bottom horizontal rail components forming a stack joint.

14 Claims, 8 Drawing Sheets

UNITIZED CURTAIN WALL SYSTEM FOR PASSIVE HOUSE STANDARD

FIELD OF THE INVENTION

The field of the invention is building construction and, in particular, curtain wall systems.

BACKGROUND

A typical curtain wall system includes extruded aluminum framing members infilled with glass, metal panels or stone, providing a building envelope enclosure. Curtain wall panels can be made with lightweight materials and such systems have become the standard for large residential and commercial building envelopes. The panels are attached to the floor slab of a building structure but do not carry the floor or roof loads of the building. With unitized systems, curtain wall panels are assembled and glazed in a factory, shipped to the building site and erected on the building. Unitized wall systems constructed indoors in controlled conditions provide a more consistent product and permit more quality and rapid installation at the building site compared to stick-built curtain wall systems.

When considering exposure to the elements, creating an effective air and water seals within panels and between a panel and the floor slab is a challenging problem. Unfavourable thermal conditions can lead to condensation (moisture) forming within the building envelope which can stain or damage interior finishes and form mold and mildew. Thermal bridging also impacts the amount of energy required to heat and cool a space and can result in thermal discomfort for building occupants. Curtain wall systems according to past approaches often experience significant increases in U-factor values, a measure of the rate of heat transfer, due to thermal bridging.

Passive House is a voluntary building standard for resiliency, comfort, and energy efficiency, which reduces the building's ecological footprint, among other benefits. One of the aims of the Passive house standard is to eliminate or minimize thermal bridges and air leakage. Designing materials and equipment, including curtain wall components and systems, including for large buildings, to meet the Passive House standard is a challenging problem.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Thus, a need exists for improved curtain wall systems with improved or alternative thermal separation characteristics.

BRIEF DESCRIPTION OF THE DRAWINGS

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
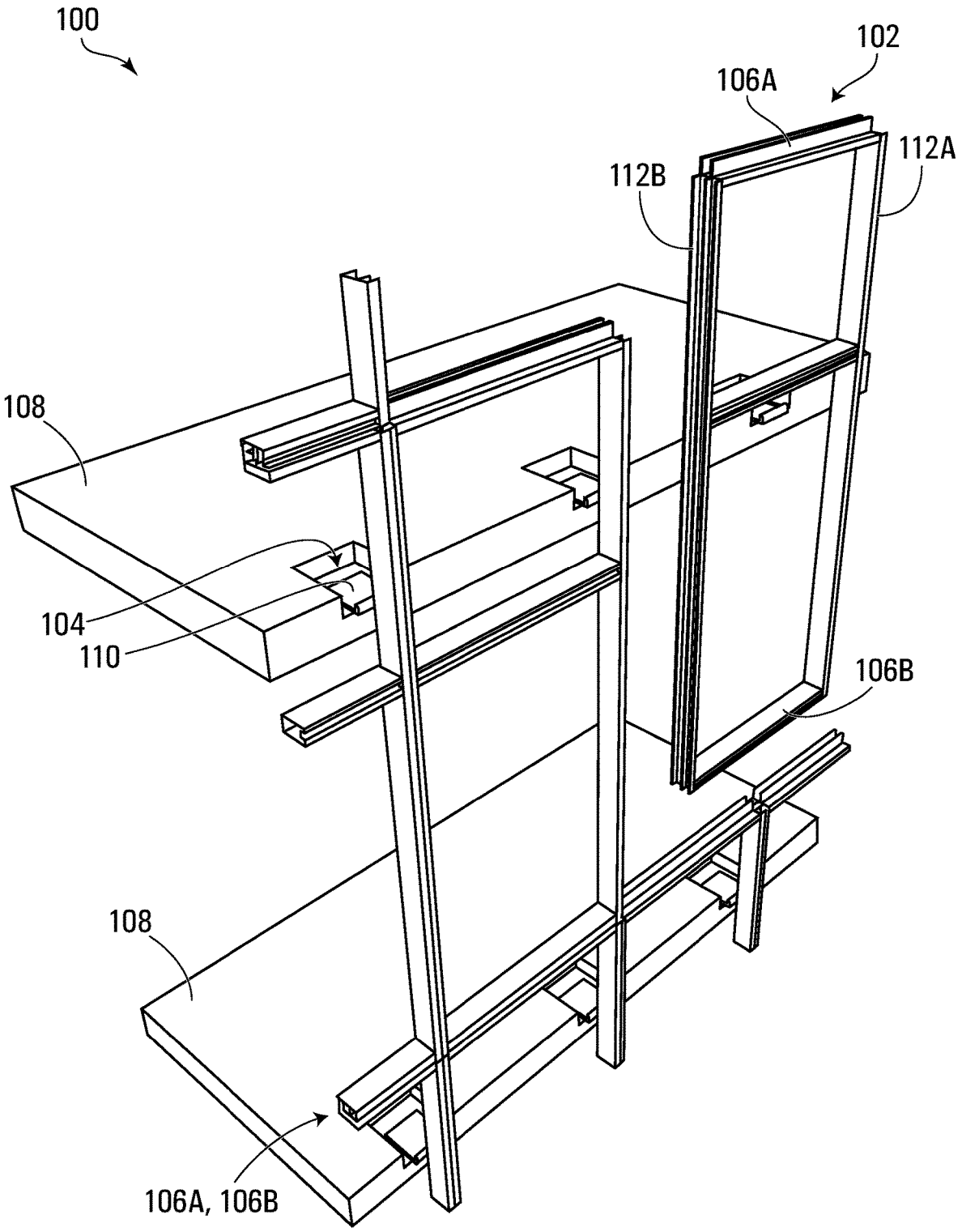
FIG. 1 is a perspective view of an exemplary unitized curtain wall system of the present specification, shown with a curtain wall unit being installed.

A unitized curtain wall system includes a framing of vertical mullion, sill stack and head assembled together to form a frame. Glass is assembled to the frame and sealed to be a panel. Embeds and anchors are installed at an on-site location to accommodate the frame. Bolts are used to connect the anchors and frames. Installation steps are repeated till the building envelope is completed.

This specification provides a unitized curtain wall system that includes pre-assembled, pre-glazed aluminum framed curtain wall units. Vertical mullion components and top and bottom horizontal rail components interconnect adjacent curtain wall panels. The curtain wall units are suspended from one or more upper anchors installed on an upper floor slab. The bottom horizontal rail components are engaged with top horizontal rail components of adjacent, lower curtain wall units forming a continuous beam scheme for vertical mullion components and configured to accept lateral loads. The gravity loads of curtain wall units are supported by one or more floor anchors. Organic shaped insulating forms are disposed laterally between top and bottom horizontal rail components of adjacent curtain wall panels. The forms are compressible to permit flexing vertical movement of the curtain wall units while reducing air movement in a horizontal cavity formed between the top and bottom horizontal rail components forming a stack joint.

One should appreciate that the systems and methods of the inventive subject matter provide various technical effects, including providing components with improved or alternative installation conformities. Thermal separation refers to isolating external cold elements and environmental conditions from interior warm framing members and indoor conditioned environment.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Examples of the present specification are marketed under the brand name PHACTOR II (Passive House Advanced Curtainwall TORonto II) and have achieved the "Advanced" phA efficiency class designation of the Passive House standard, as discussed in more detail below.

Generally speaking, curtain wall systems are required to resist many different forces in the provision of a suitable separation of indoor and outdoor environments. They are required to:

a. Have sufficient structural strength and rigidity;
b. Resist the spread of fire;
c. Address building aesthetics;
d. Be durable;
e. Control odours;
f. Control light;
g. Control sound and vibration;
h. Control energy flow;
i. Control air flow;
j. Control water vapour flow;
k. Control exterior precipitation;
l. Control solar radiation; and
m. Control visual contact between interior and exterior.

While each of these requirements is important, deficiencies in the performance of walls relate to some requirements more frequently than others. Accordingly, these requirements have a greater potential for damage, either physical or financial. The rate of occurrence of defects in certain aspects of wall performance has generated in the industry a need for reference material. The glass and metal curtain wall, in all its forms ranging from single-storey, storefront applications to towering skyscraper cladding, has become one of the most popular forms of building cladding. Owing to this popularity, the more general term "curtain wall", while actually defining and encompassing a very broad spectrum of different wall types, has become the everyday reference to glass and metal curtain wall. The two terms are used interchangeably.

A modern curtain wall, by its nature, is a highly engineered product based on sophisticated industrial processes and concepts of mass production, standardization, precise tooling and machining. Unlike traditional walls, curtain walls are typically designed, manufactured and installed by one contractor. Much like the modern automobile with "no user serviceable parts", the curtain wall is often treated as a "black box" and the design professionals actually participate little in the wall design. This lack of detailed design involvement leads to an increased reliance on the curtain wall developer for technical expertise and, too often, an inability on the part of the professionals to properly assess the suitability of particular designs proposed by suppliers A glass and metal curtain wall, in its basic form, consists of a lightweight metal grid-work with some combination of transparent or opaque infill panels. The grid, of either tubular or open shaped pieces can be assembled as individual pieces in the field (stick) or as part of factory preassembled panels (unitized). In either case, the grid is typically attached at discrete points to the floor slab edges, hanging like a curtain down the building. Glass forms one of the most popular infills as vision panels or, when coated, opaque spandrel panels. A wide variety of other materials such as stone, steel, aluminum, composites and plastics are used as curtain wall panels.

A curtain wall is a unique wall assembly with regards to the number, type and level of performance tests used for its assessment. Regardless of the sophistication of the product or the testing programme, curtain walls must meet the same basic performance criteria as all wall types.

The lightweight, thin and non-absorbent nature of glass and metal imposes special constraints on the wall design to meet the basic performance criteria. For example, a metal and glass curtain wall must control water penetration by either a positive seal or by drainage, as it has no ability, like masonry or stone, to absorb and store water for re-evaporation. The modular gridwork layout of a curtain wall creates the potential for pressure-moderated rain-screen performance but this potential is only realized through careful detailed design and construction.

Characteristics and features of stick wall systems include:

a. Likely most common wall system especially on low-rise construction and in smaller population centres;
b. Each component of wall is installed piece by piece in the field. Installed with one- or two-storey mullion lengths and horizontal rails equal in length to width of the infill panels;

c. Field labour intensive and dependent;
d. Minimum requirements for assembly facilities and shipping;
e. Normally short lead time to arrive on-site, but longer erection/close-in time on-site;
f. Difficult to accommodate in-plane movements due to sway or seismic events; and
g. Depend on wet seals for:
   i. air and water tightness plane continuities,
   ii. Accepting dynamic main buildings' skeletal framework movements, and
   iii. curtainwall system's own tolerances and thermal expansion contraction variances.

achieved with either stick or unitized systems. However, due to the inherent quality control achievable in the factory assembly of the unitized system, and their dry-seals approach, the potential for a higher quality project is increased using a unitized system. This potential is not always realized due to poor joint design to control air and water. Stick systems have problems mainly at the expansion joint where unitized systems add the vertical mullion joint which often compounds the expansion joint problem through the service life of the building. Additional comparisons between stick and unitized systems are set out in Table 1 below.

TABLE 1

Comparison Between Stick and Unitized Curtain Wall Systems

| Factor | Applicability - Stick or Unitized System |
|---|---|
| Architectural Design | Most architectural designs can be executed in either system. Very long spans, especially near ground floor areas, are often more suited to stick systems. Structural silicone glazed systems must be pre-glazed unitized systems, making available shop facilities essential. |
| Cost/Budget Size | The greater the project size, the greater the potential economy in unitized systems. Very small projects are almost exclusively completed using stick systems. |
| Cost/Budget Shape | Very complex facades with little repetition, varying module size and spans make unitized systems less economical. |
| Schedules | Advantages of one system over another depends on particular schedule demands. Standard stick systems can be fabricated and to the field quickly but take longer to close-in. Unitized systems take longer to arrive on-site due to plant assembly but close-in the building quickly once on-site. |
| Location Contractor | Unitized systems require greater investment in plant and equipment and hence contractors are generally larger and located near major centres. |
| Location Seismic | Stick systems, due to the sleeving of vertical mullions and the racking induced by lateral movements, are less able to accommodate seismic movements. Properly designed unitized systems can typically better accommodate seismic events. |

Characteristics and features of unitized wall systems include:

a. Most common to large high-rise buildings although found on buildings as low as four stories. System has grown in popularity since 1980;
b. Large factory assembled framed units complete with spandrel panels and often with vision panes installed. Panels typically one-storey high by width of infill panels;
c. Panels designed for sequential installation with interlocking split vertical mullions and nesting horizontal rails at expansion joint;
d. Significant fabrication facility and shipping requirement. More shop labour dependant and less field dependant than stick system;
e. Normally longer lead time to arrive on-site, but rapid erection with minimum time to close in building once on-site;
f. Design potential to accommodate in-plane movements due to sway and seismic events; and
g. Depend on extruded dry gasket seals for:
   i. air and water tightness plane continuities,
   ii. accepting dynamic main buildings' skeletal framework movements, and
   iii. curtainwall system's own tolerances and thermal expansion contraction variances When considering the differences between stick and unitized systems, adequate quality and durability can be Passive House is a building standard that is energy efficient, comfortable and affordable at the same time. Passive House is not a brand name, but a construction concept that is more than just a low-energy building. For example, Passive House buildings allow for space heating and cooling related energy savings of up to 90% compared with typical building stock and over 75% compared to average new builds. Passive House buildings use less than 1.51 of oil or 1.5 $m^3$ of gas to heat one square meter of living space for a year—substantially less than common "low-energy" buildings. Significant energy savings have been demonstrated in warm climates where typical buildings also require active cooling.

Passive House buildings make efficient use of the sun, internal heat sources and heat recovery, rendering conventional heating systems unnecessary throughout even the coldest of winters. During warmer months, Passive House buildings make use of passive cooling techniques such as strategic shading to keep comfortably cool.

Passive House buildings are praised for the high level of comfort they offer. Internal surface temperatures vary little from indoor air temperatures, even in the face of extreme outdoor temperatures. Special glazing and a building envelope consisting of a highly insulated roof and floor slab as well as highly insulated exterior walls keep the desired warmth in the building—or undesirable heat out.

A ventilation system imperceptibly supplies constant fresh air, making for superior air quality without unpleasant draughts. An efficient heat recovery unit allows for the heat contained in the exhaust air to be re-used.

An institute was founded in 1996 which evaluates the building components demonstrating compliance with the Passive House standard. The Passive House Institute (PHI) is an independent research founded by Dr. Wolfgang Feist with a continuously growing interdisciplinary team of employees. PHI has played an especially crucial role in the development of the Passive House concept. The first pilot project (Kranichstein Passive house, Darmstadt, Germany, 1990) was Europe's first inhabited multi-family complex to achieve a documented heating energy consumption of below 10 kWh/($m^2$a), a consumption level confirmed through years of monitoring.

The Passive House Institute has assumed a leading position with regard to research on and development of construction concepts, building components, planning tools and quality assurance for especially energy efficient buildings. PHI has been responsible for the building physics related consultancy and technical guidance on a number of firsts including the first Passive House office building, the first Passive House factory, the first Passive House schools and gymnasiums, the first Passive House indoor pool halls and the first Passive House retrofits. The Institute is currently providing such expertise for numerous new, innovative projects.

The present specification provides examples of curtain wall systems and components that are aimed to satisfy the Passive House standard performance criteria.

When comparing traditional curtain wall systems to examples of the present specification, traditional curtain wall systems have struggled to improve thermal performance, hygiene and energy efficiency characteristics. Various manufacturers strive to comply with basic regional or national codes' requirements, and certain projects specification.

Only a limited number of curtain wall systems have achieved certification based on the Passive House standard criteria worldwide.

To meet the Passive House standard, PHI provides performance value minimums climate zone based. For many regions of Canada and elsewhere, the climate zone will be cool-temperate, as shown in Table 3 below. The performance criteria and U-values relative to the examples of the present specification marketed under the brand PHACTOR II are set out in Table 2 below.

TABLE 2

PHACTOR II Performance

| | Certification criteria and U-values with the Reference Glazing of 0.7 W/$m^2$K | |
|---|---|---|
| | Adequate [Cool-temperate] | PHACTOR II Performance |
| Hygiene criterion | $f_{RSi}$ = 0.25 ≥ 0.7 | $f_{RSi}$ = 0.25 [0.83-0.84] |
| Component U-value | 0.8 W/$m^2$K | 0.79 W/$m^2$K |
| U-value installed | 0.85 W/$m^2$K | 0.83 to 0.85 W/$m^2$K |

Figure 8:
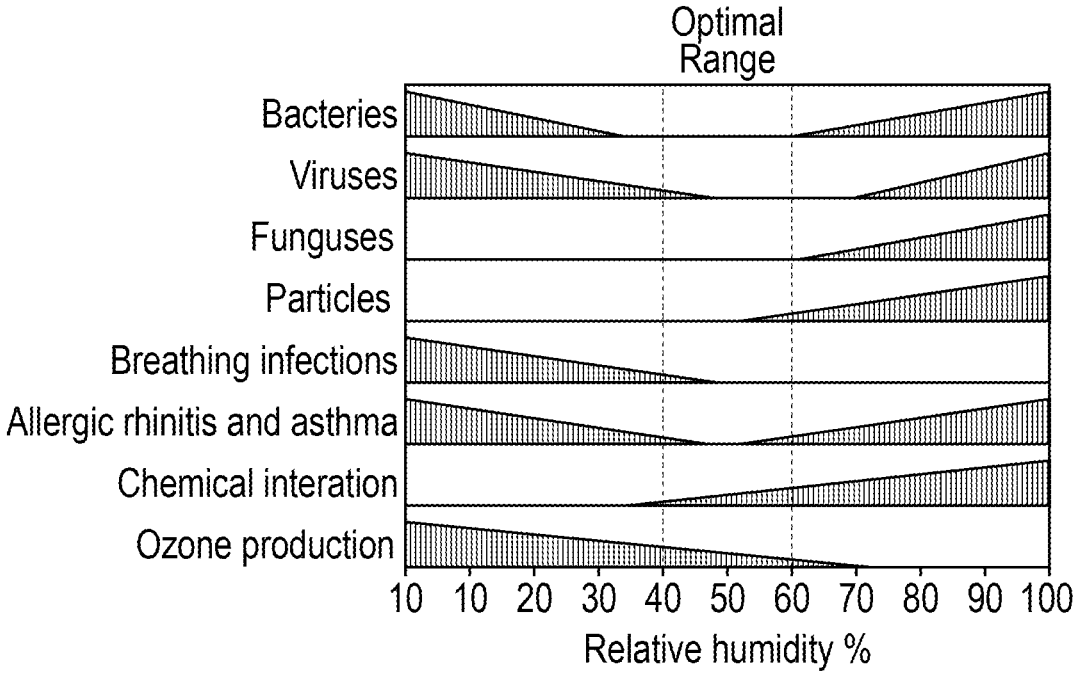
FIG. 8 is a table illustrating relative humidity and Occurrence of indoor effects.

An important characteristic of the Passive House standard is hygiene. Hygiene refers to conditions or practices conducive to maintaining health and preventing disease, especially through cleanliness. In an indoor environment of a building, the growth or activity of pathogens such as bacteria, viruses, fungi and conditions such as infections etc. risks increase when the value of Relative Humidity (RH) is very low or very high (e.g., below 40% or above 60% where there will be significant condensation risk). Signs of high and low humidity in a building are shown in Table 4. The occurrence of undesired indoor effects compared to RH values is shown in FIG. 8. The Passive House standard requires condensation-free interior building envelope surfaces to approximately an RH of 57%. Most traditional curtain wall systems can tolerate up to 30-40% indoor relative humidity during cold winter periods in cool-climate temperate geographical zones, which include most North American cold climate zones.

Many project plans have been recently forced to accept low Relative Humidity levels, regardless of human health and comfort design requirements (40% -60% RH) for indoor spaces, because many building envelope components, expressly glazing elements, could not maintain condensation-free surfaces during cold weather periods.

Lower RH also causes eye dryness and irritation, skin gets flaky and itchy and the low humidity inflames and dries out the mucous membrane lining the respiratory tract. As a result, the risk of cold, flu and other infections is increased.

For a building to be considered a Passive House, it must meet the buildings' air-tightness criteria of a maximum of 0.6 air changes per hour at 50 Pascal pressure (ACH50), as verified with an onsite pressure test in both pressurized and depressurized states.

According to examples of the present specification, curtain wall systems, considered one of the main building envelope components, include appropriately designed continuous seals to provide the air-tightness criteria required for the Passive House certification process. Exemplary sealing components include insulating forms as discussed below with reference to the drawings, provide the air-tightness required to meet the Passive House performance criteria.

TABLE 3

Passive House selected boundary conditions by region

| Region | | Boundary condition for hygiene criteria | | Hygiene criterion | | Ambient temperature for comfort | Maximum heat transmission coefficient | | | |
|---|---|---|---|---|---|---|---|---|---|---|
| No. | Name | $\theta_a$ | rHi | $\theta_{Si}$, min | $f_{RSi}$ | criterion (° C.) | Orientation | [°] | Uw, $_{inst.}$ | Uw |
| 1 | Arctic | −34.00 | 0.40 | 9.20 | 0.80 | −50 | vertical | 90 | 0.45 | 0.40 |
| | | | | | | | inclined | 45 | 0.50 | 0.50 |
| | | | | | | | horizontal | 0 | 0.60 | 0.60 |
| 2 | Cold | −16.00 | 0.45 | 11.00 | 0.75 | −28 | vertical | 90 | 0.65 | 0.60 |
| | | | | | | | inclined | 45 | 0.70 | 0.70 |
| | | | | | | | horizontal | 0 | 0.80 | 0.80 |
| 3 | Cool-temperate | −5.00 | 0.50 | 13.00 | 0.70 | −16 | vertical | 90 | 0.85 | 0.80 |
| | | | | | | | inclined | 45 | 1.00 | 1.00 |
| | | | | | | | horizontal | 0 | 1.30 | 1.30 |
| 4 | Warm-temperate | 3.00 | 0.55 | 14.00 | 0.65 | −9 | vertical | 90 | 1.05 | 1.00 |
| | | | | | | | inclined | 45 | 1.10 | 1.10 |
| | | | | | | | horizontal | 0 | 1.20 | 1.20 |
| 5 | Warm | | | | 0.55 | −4 | vertical | 90 | 1.25 | 1.20 |
| | | | | | | | inclined | 45 | 1.30 | 1.30 |
| | | | | | | | horizontal | 0 | 1.40 | 1.40 |
| 6 | Hot | not relevant | | not defined | | not relevant | | | 1.25 | 1.20 |
| 7 | Very hot | not relevant | | not defined | | not relevant | | | 1.05 | 1.00 |

TABLE 4

Signs of high and low humidity

| Too Dry | | Too Humid | |
|---|---|---|---|
| Dry skin | Itchy Throat | Mold and mildew | Dust mites |
| Dry eyes | Asthma | Feeling stuffy | Visible condensation |
| Coughing | Allergies | Allergies | Sinus problems |
| Sinus Problems | | Asthma | |

With the Passive House standard, high demands are placed on the quality of the building components. In part this is because the standard does not require a separate heating system. And, generally speaking, the colder the climate, the higher the requirements for the components. To address this, PHI has identified regions of similar requirements, and defined certification criteria, as shown in Table 5 below. If no radiator is placed under the window, its thermal transmittance UW (U-value) may not exceed a climate-dependent value in order to prevent unpleasant radiation losses and cold down droughts. For a given quality of glazing, this results in restriction of the thermal losses of the window frame and the glass edge. In that context, the installation situation of the window in the wall is relevant. Because of that, a UW, installed exemplary test value for the certification has been defined.

Certified glazing systems are ranked by the thermal losses through the non-transparent parts. These efficiency classes, shown in Table 6 below, include the U-Value of the frame, the frame width, the Ψ-Value of the Glass edge and the length of the Glass edge.

Relevant for Passive House buildings is the energy balance, that is, the sum of losses and gains. Because the solar gains are difficult to measure, it is useful to rate the parts of the window, which do not allow solar gains. This is determined by Ψ opaque.

TABLE 6

Passive House Standard certification criteria and U-values

| Climate Zone | Hygiene Criterion $f_{Rsi}$ = 0.25 $m^2K/W$≥ | Component U-value[1] [W/($m^2$K)] | U-value installed [W/($m^2$K)] | Reference glazing [W/($m^2$K)] |
|---|---|---|---|---|
| Arctic | 0.80 | 0.40 | 0.45 | 0.35 |
| Cold | 0.75 | 0.60 | 0.65 | 0.52 |
| Cool-temperate | 0.70 | 0.80 | 0.85 | 0.70 |
| Warm-temperate | 0.65 | 1.00 | 1.05 | 0.90 |
| Warm | 0.55 | 1.20 | 1.25 | 1.10 |
| Hot | None | 1.20 | 1.25 | 1.10 |
| Very hot | None | 1.00 | 1.05 | 0.90 |

TABLE 7

Passive House Standard efficiency classes for transparent building components

| Ψopaque [W/(mK)] | Passive House efficiency class | Description |
|---|---|---|
| ≤0.065 | phA+ | Very advanced component |
| ≤0.110 | phA | Advanced component |
| ≤0.155 | phB | Basic component |
| ≤0.200 | phC | Certifiable component |

$$\Psi_{opal} = \Psi_g + \frac{U_f \cdot A_f}{l_g} + H_{vc} + 2 \cdot \chi_{gc}$$

Examples of the present specification provide a two-sided capped, silicone-glazed curtain wall that is up to 3 to 5 times or more energy efficient than other recent curtain walls on the North American markets. Features include:

a. R-Value: [R 7.2 hr-ft2-° F./Btu] vision area including frame thermal resistance;
b. U-value Glass [U =0.70 W/$m^2$K] energy transmission;
c. U-value Glass+Frame overall [U=0.79 W/$m^2$K] energy transmission; and
d. Many glazing options [e.g., three or more panes].

Examples of the present specification provide unitized curtain wall systems certified by the Passive House Institute.

As noted above, curtain wall systems are used for building envelopes, replacing concrete or brick walls. Examples of the present specification were developed by designing unitized components as evaluated through thermal analysis software. Technical data information and drawings demonstrate thermal performance results meeting the Passive House standard. It is believed that PHACTOR II is the first aluminium North American curtain wall system certified with Passive House standard and the first Passive House certified unitized curtain wall system worldwide.

The built environment is now being challenged under the present circumstances of the COVID-19 pandemic. The appropriateness and resilience of building spaces in resisting the pandemic's consequences has been questioned by building construction stakeholders.

Examples of the present specification address at least some COVID-19 pandemic-related concerns.

Figure 7:
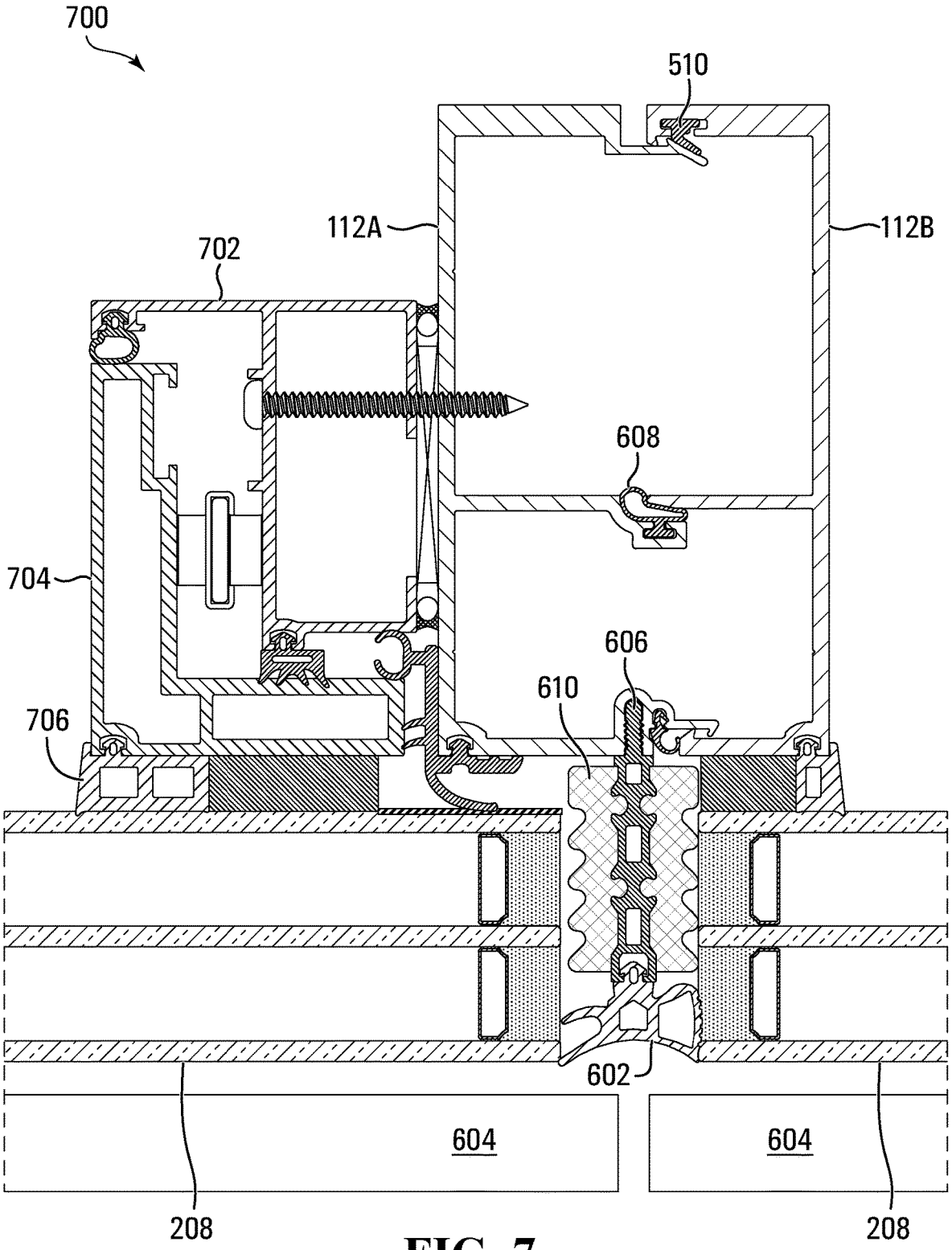
FIG. 7 is a cross-sectional view of two vertical mullion components of an exemplary unitized curtain wall system of the present specification, with an operable window.

Natural Ventilation. While natural ventilation is crucial for bringing in fresh outdoor air into buildings, operable windows have not been predominantly considered in most recently built enclosures. Fixed glazing is the primary practiced approach. Examples of the present specification, including the example shown in FIG. 7, are equipped with operable vents, included in the Passive House certification. Opening windows helps extract airborne contaminants from the space, making infections less likely. Homes, schools, and office buildings are typically chronically under-ventilated. This not only gives a boost to disease transmission, including illnesses like the norovirus or the common flu, but can also significantly impair cognitive function. Generally speaking, buildings and interior spaces without operable windows are questionable from a resiliency perspective, and whether they can remain occupied in cases of power or mechanical ventilation failures.

Relative Humidity. As noted above, examples of the present specification are designed to withstand healthy Relative Humidity (RH) levels without suffering any condensation, which most traditional curtain walls suffer from during cold outdoor periods. Research demonstrates that keeping the RH between 35 percent and 55 percent reduces the transmission of viruses. It is noted that the higher the RH, the more quickly the virus containing micro droplets fall to the floor. Research continues to reveal that dry indoor air is connected to more human transmission. This explains why the flu spreads, when cold outdoor air, already low in moisture content, is brought inside and further dried out when heated. One solution is to provide sufficient indoor humidification to achieve a healthy RH level between 40% to 60%. The problems of condensation, and mold or bacterial growth remain challenging for glazed building envelopes that do not incorporate the disclosed features of the present specification.

Economics. Uncontrolled energy gain or loss through insulated building walls is costly. As noted above, examples of the present specification achieved R7.2 hr.ft$^2$.° F./Btu under test on the thermal resistance scale in vision glazing spans, including related framing. Higher R-values are projected in opaque spans. This helps separate interior conditioned space temperatures from the exterior element, so the occupants are much more comfortable and productive. The cost of heating/cooling can be reduced or minimized. One does not have to pay much to condition the space, which is quite helpful in challenging economic times.

More generally, examples of the present specification support the implementation of the Passive House building standard. The Passive House (PH) model emphasizes a high standard of building insulation and controlled ventilation with heat recovery in order to achieve comfort and reduce energy use. Environmental control is achieved by the building fabric and ventilation system with little need for significant energy consuming mechanical gear to accomplish comfort and efficiency. PH ventilation is based on fresh air supply in lieu of traditional air recirculation.

There a number of challenges with traditional approaches to HVAC recirculating air. Focusing on virus transmission, air quality in buildings has considerable implications. Large droplets/particles (up to 10 microns) emitted when sneezing, coughing or talking are mostly transmitted either through the air or via surface contact (e.g., hand to hand, hand to surface, etc.). Small particles (up to 5 microns), generated by coughing and sneezing, may stay airborne for hours, and can travel long distances. A coronavirus particle is only 0.8 to 0.16 microns in diameter thus there could be many virus particles in a 5 micron droplet floating in the air. Air recirculation has always been fundamentally unhygienic, not providing enough oxygen, even apart from current virus transmission concerns.

Traditional HVAC design posits that air recirculation is perfectly normal, but this view has attracted some doubt. According to one example, the Passive House standard requires up to 100% fresh air with heat recovery ventilation, a more hygienic concept. The 100% fresh air ventilation flow gains a minimum of 70% of its required warmth conditioning temperateness from a heat recovery ventilator (HRV). The technique is now widely applied to both domestic and large public PH buildings. The Passive House principles, including operable windows also for passive cooling strategies, which were created in Germany at times where indoor air quality was noticeably diminishing, while buildings were typically oil/hot-water radiator heated. Occupants probably had to set several calendar reminders throughout the day to open up windows and exchange used air with fresh air, sacrificing expensive conditioning energy. Some earlier North American structures were similarly built, until mechanical ventilation was introduced. But that did not resolve the fresh air requirement, instead, the problem of air recirculating began.

FIG. 1 illustrates an exemplary unitized curtain wall system 100, with a curtain wall unit 106 being installed into place. In this example, the curtain wall unit 102 is a pre-glazed unit (also known as a unitized curtain wall unit) generally made up of two or more pieces or panes of flat glass separated by sealed air space (in a preferred but not limiting example there are three panes of glass and the pane thickness is 48 mm (4/18/4/18/4 mm) and the rebate depth is 17-32 mm). The curtain wall unit 102 includes glass 208 and glass 206 (shown in FIG. 2). According to one example, a warm edge spacer bar such as the brand Swisspacer Ultimate, separates the panes of glass in triple glazing of the curtain wall unit 102. The in-fill of the curtain wall unit 102 can be glass (transparent or opaque), stone, aluminum composite panel, or any opaque or semi-opaque material. The curtain wall unit 102 is framed by horizontal rail components 106A and 106B and vertical mullion components 112A and 112B. The components can be made of aluminum in one example. When assembled together horizontal rail components 106A and 106B of adjacent units form a stack joint 106 and vertical mullion components 112A and 112B form a vertical mullion 112. Horizontal rail component 106A is also known as a frame head. Horizontal rail component 106B is also known as a frame sill. It will be appreciated that the curtain wall unit 102 is pre-assembled at a factory for installation at a site either from the interior of the building using a beam on the floor above using a wire rope compact hoist crane, or a mini spider crane. The curtain wall unit 102 is fastened to the concrete floor or slab 108 using anchors 110 located at anchor pockets 104. In other examples, and depending on the building, the curtain wall units 102 may be fastened to hollow structural steel tubes, I-beams, or wood slabs, etc.

Figure 2:
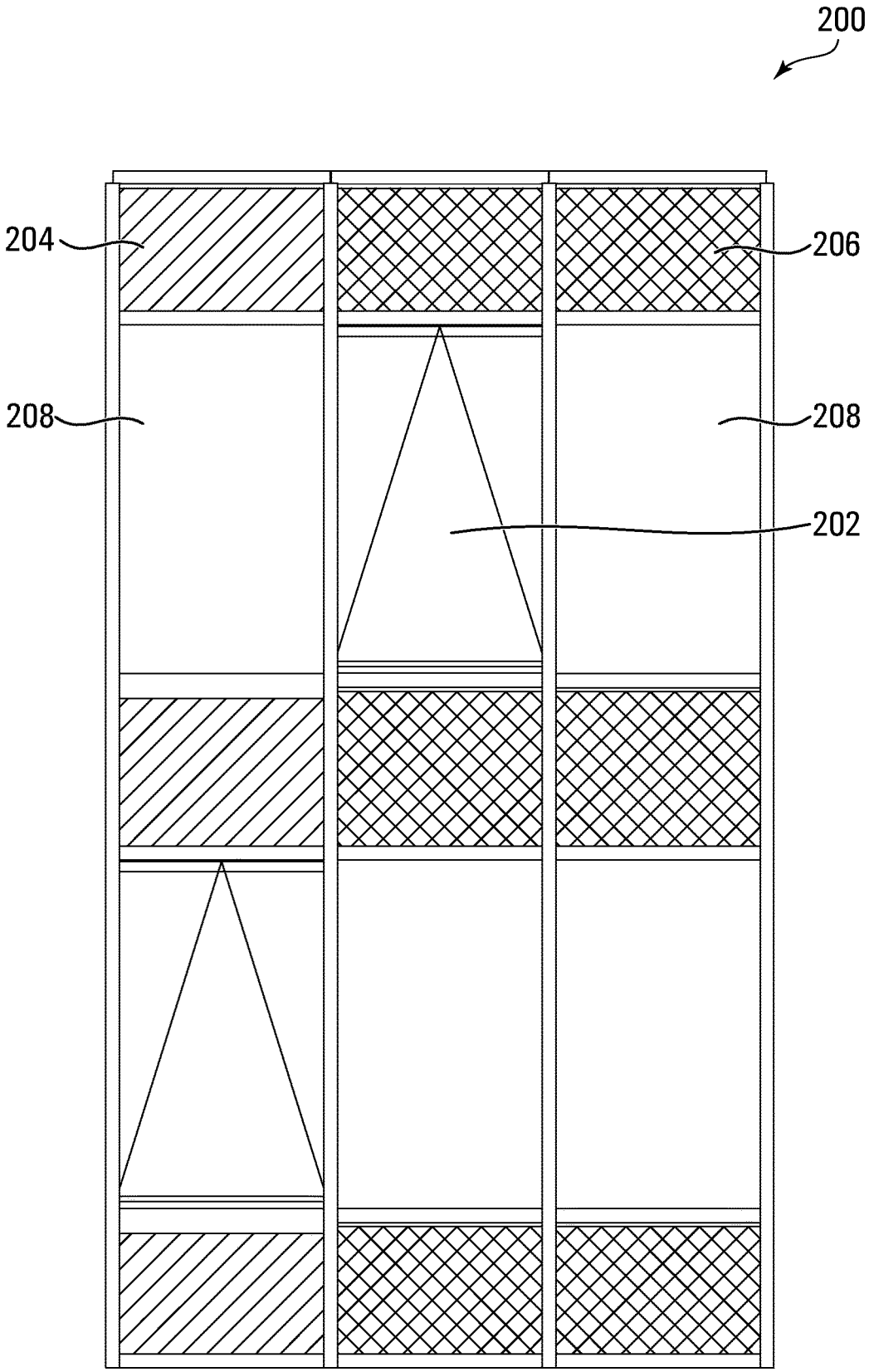
FIG. 2 is a front elevation view of an exemplary unitized curtain wall system of the present specification.

Now with reference to FIG. 2, an exemplary unitized curtain wall system 200 includes a plurality of glass 208, an operable vent/window 202, spandrel glass 204 and a stone panel 206. Different in-fill materials, transparent, opaque or semi-opaque, as known to those of skill practising in the art can be used and are intended to be include within the present specification.

Figure 3:
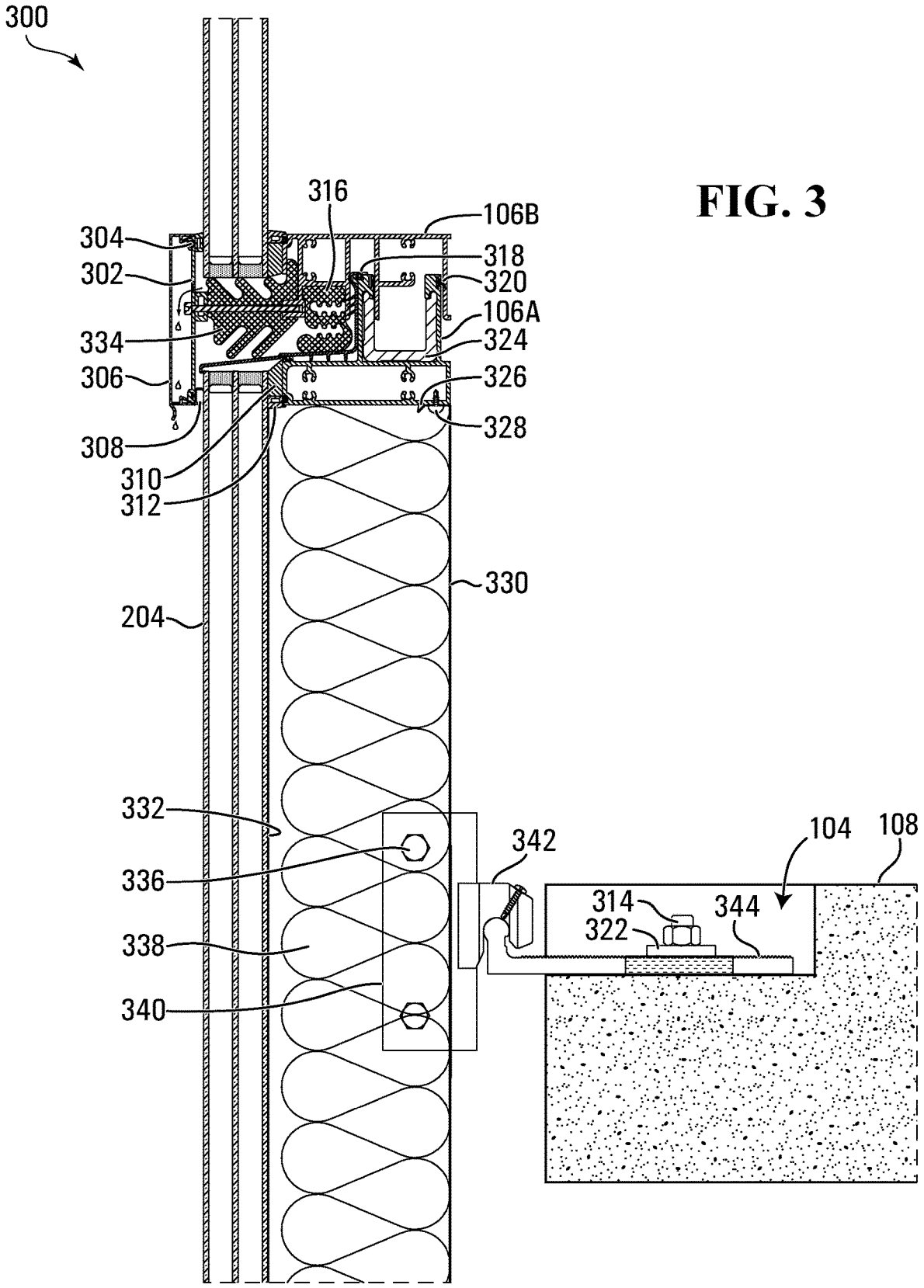
FIG. 3 is a cross-sectional view of two horizontal rail components of an exemplary unitized curtain wall system of the present specification, at a junction.

Turning to FIG. 3, a curtain wall system 300 is illustrated at a vertical cross-section, showing two horizontal rail components 106A and 106B, at a junction between glass 208 above and a spandrel glass 204 below. The spandrel glass 204 includes three panes of glass that includes an opaque surface 332 and insulation 338 between the glass and a back-pan 330 which may be made of galvanized steel in one example. The insulation 338 may be semi-rigid mineral wool in one example.

The anchor pocket 104 of the concrete slab 108 is cut away to show a serrated outrigger plate 344 (with an adjustment slot hole) and a serrated locking plate 322. A stainless steel bolt and nut 314 is used to fasten the plate 344 to the slab 108. The plate 344 carries the weight of the curtain wall unit 102 using a hook bracket 342 at a portion of the spandrel glass 204 with a mullion bracket 340 fastened to the bolt and nut 336 (with lock washer).

As shown at a top portion of FIG. 3, junction cavities formed in the horizontal rail components 106A and 106B are filled by organic forms 334 and 316. The organic form 334 is finger-shaped to provide bulk for thermal separation but has spaces to permit flexing. The organic form 316 is S-shaped for similar reasons. The organic forms can be extruded cuttings in one example. A pressure plate 302 fastens to the outside to secure the glass and a horizontal cap 306 extends along the length of the stack joint 106 to provide glass support and protection from the elements. Use of the term organic generally refers to shapes that are found in nature that can be irregular or asymmetrical, rather than perfect geometric shapes. The term organic extends to shapes that are more or less organic and/or more or less geometric that provide the functionality of providing bulk, permitting compression, or both.

A number of gaskets provide for various levels of seals, including rain screen gasket 304, sliding gasket 308, interior glazing gasket 312, horizontal air seal gasket 318, and horizontal gasket 320. Additional or fewer gaskets may be used without departing from the scope of the present specification. A silicone perimeter sealant 326 and a sealed screw head with silicone 328 act as air seals in one example is DOWSIL™ 795. A frame splice/alignment/transfer bar 324 is connecting the units laterally.

Figure 4:
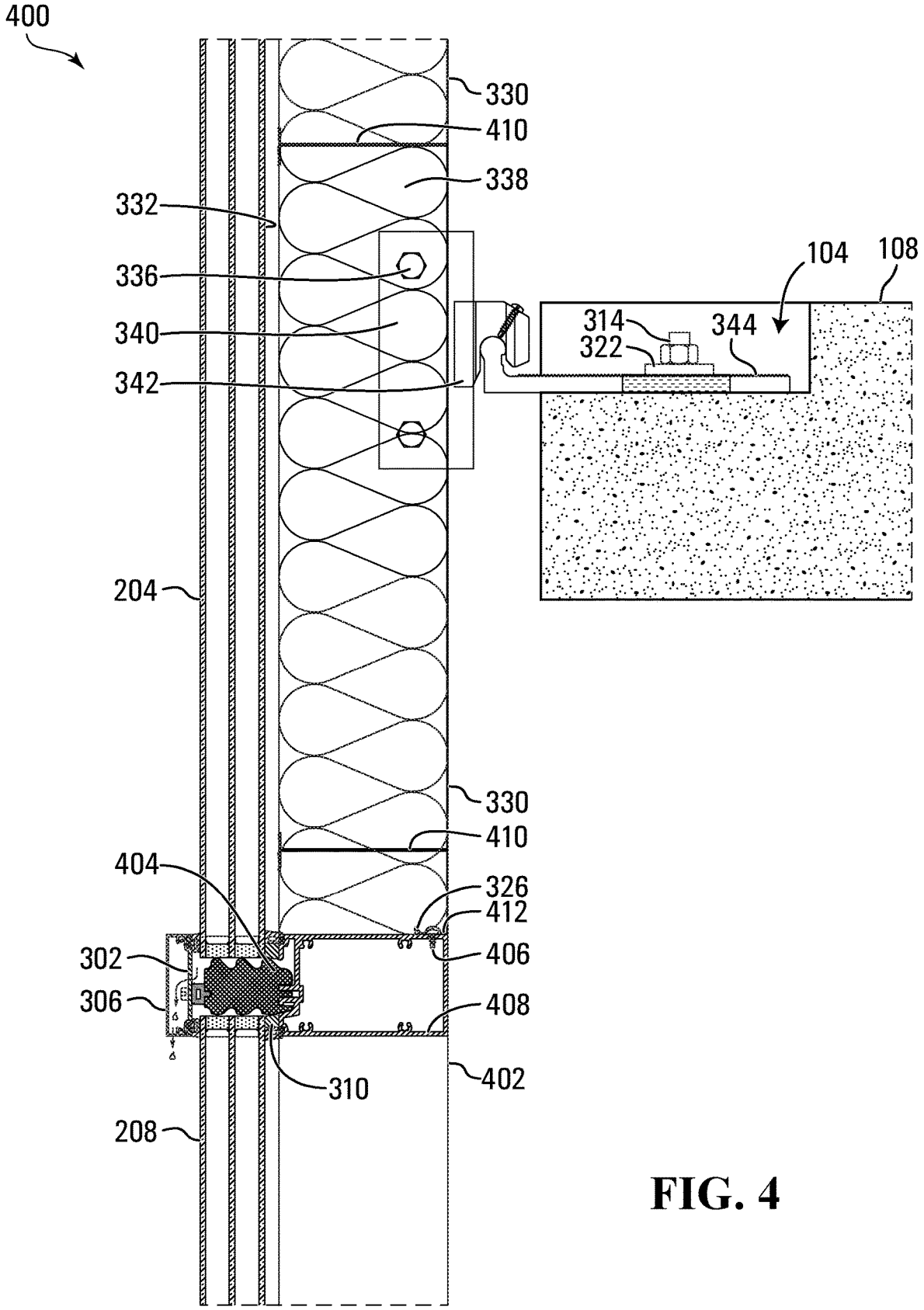
FIG. 4 is a cross-sectional view of a horizontal transom of an exemplary unitized curtain wall system of the present specification, at an intermediate section.

With reference to FIG. 4, a curtain wall system 400 including a horizontal transom 408 is shown at an intermediate section. As with the organic forms described with reference to FIG. 3, an organic form 350 is disposed horizontally within the transom 408. A weld stick pin 410 supports the insulation. A pan head 412, which can be made of stainless steel, supports the back-pan to the curtain wall frame. A screw head seal with silicone 406 ensures air and water tightness. The line beyond 402 indicates the vertical mullion.

Figure 5:
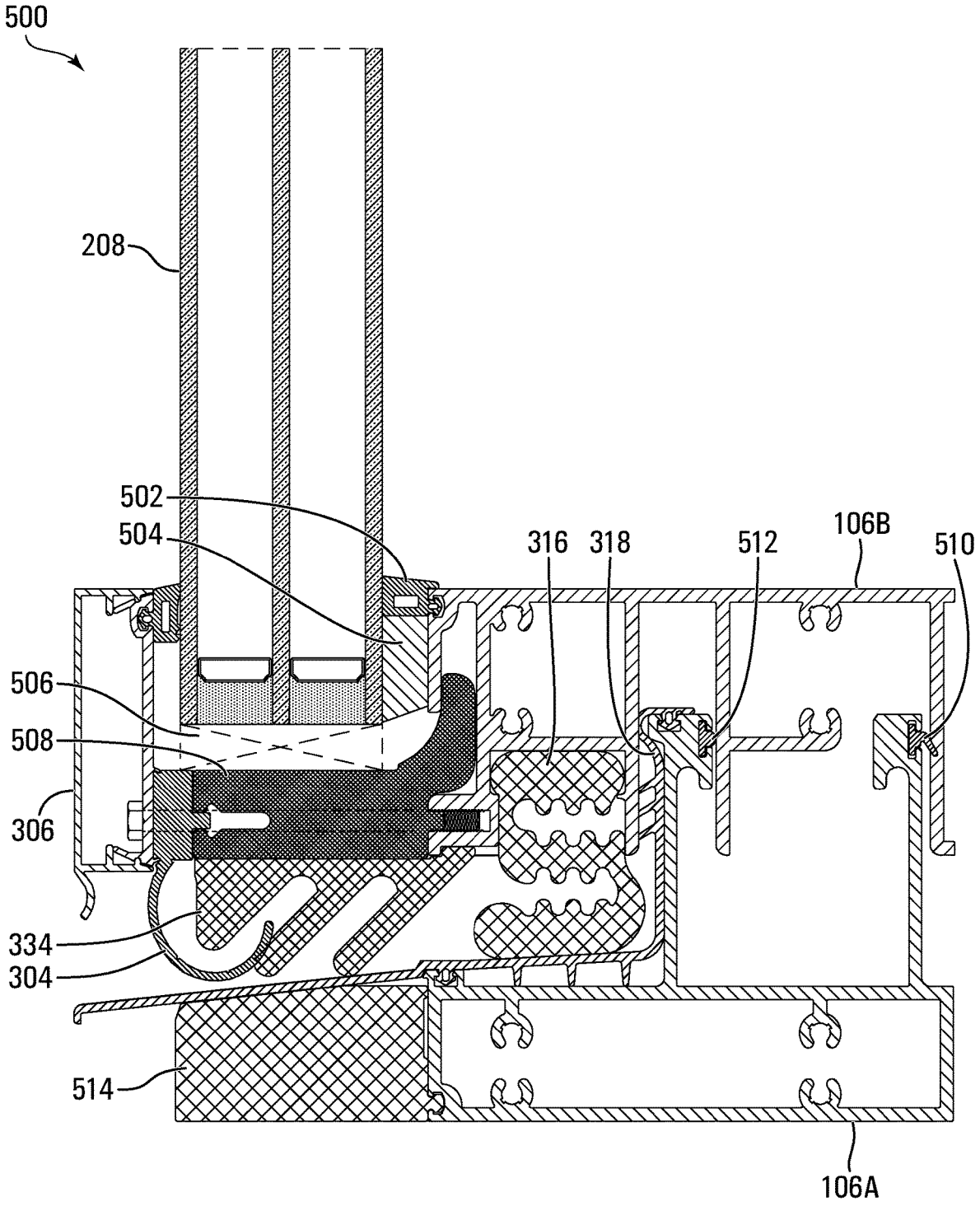
FIG. 5 is a cross-sectional view of two horizontal rail components of an exemplary unitized curtain wall system of the present specification, at a sill head.

Turning to FIG. 5, two horizontal rail components 106A and 106B of a curtain wall system 500 are shown at a sill head. A setting block 506 transfers the glass load to glass saddle. A rigid PVC spacer 512 helps vertical gliding for stacked 106A+B. Interior silicone glazing gasket 502 ensures air and/or water tightness, silicone smoke seal gasket 510, controls smoke migration. Graphite polystyrene (GPS) 514 provides thermal insulation. Woolglass-Chair 508 provides glass dead load baring support. Silicone 504, which may be Dowsill 983 silicone, provides additional air+water seals, and lateral structural support.

Figure 6:
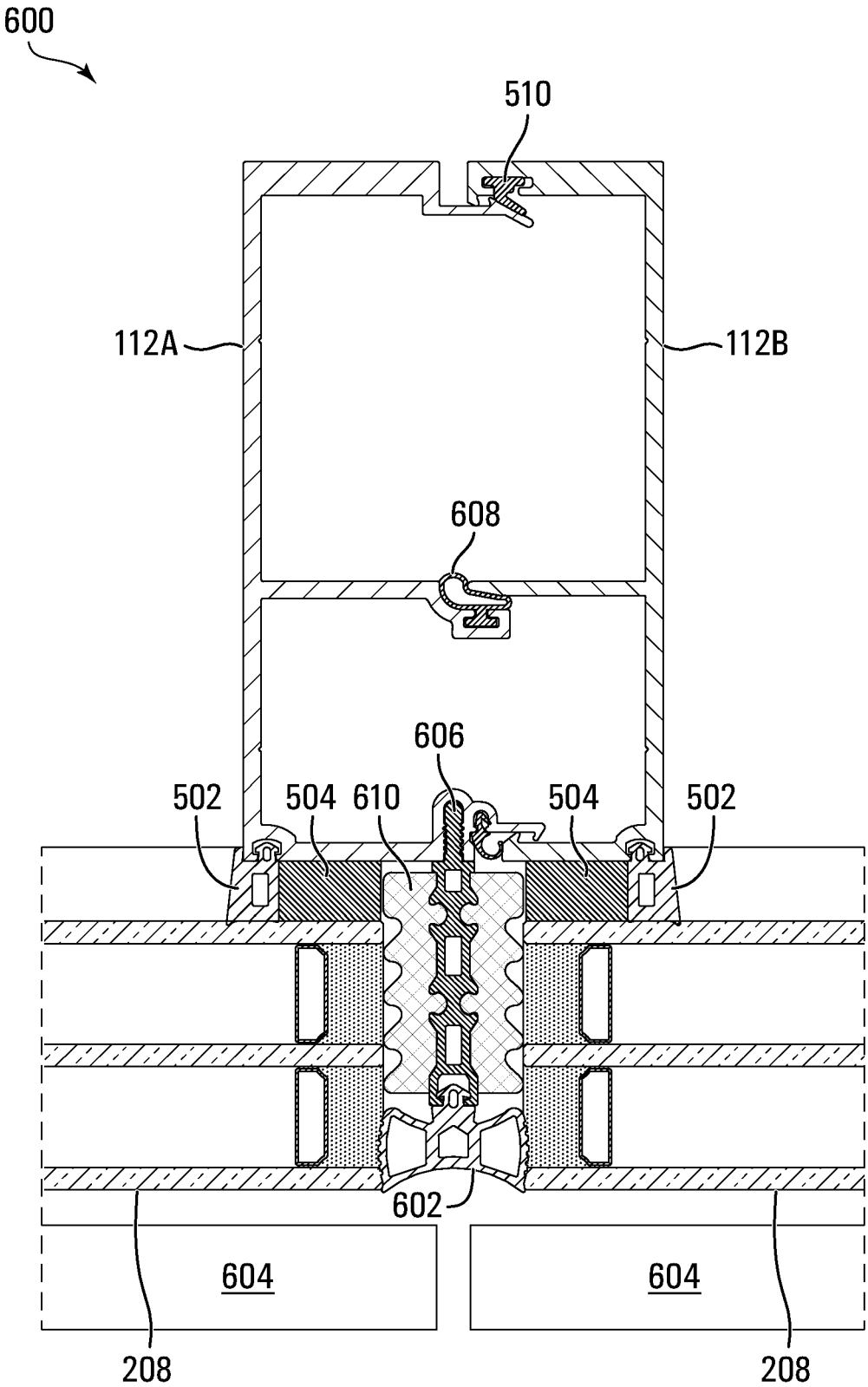
FIG. 6 is a cross-sectional view of two vertical mullion components of an exemplary unitized curtain wall system of the present specification.

Moreover, FIG. 6 depicts two vertical mullion components 112A and 112B of an exemplary curtain wall system 600 of adjacent glass 208. A horizontal cap 604 is covering the horizontal pressure plate. Vertical silicone rainscreen gasket 602, air seal gasket 608 provides ultimate air tightness. Rigid PVC gasket hanger 606 provides support for gasket 602 and organic GPS extrusion 610.

Turning to FIG. 7, two vertical mullion components 112A and 112B of a curtain wall system 700 are shown according to an alternative example, with an operable window frame 702. A vent operable sash 704 that is an outswing including the supported glass. A glazing gasket 706 provides glass 102 padding and perimeter seals.

Curtain wall units 106 are lifted by wire rope compact hoist or a mini spider crane to location 100 mm higher than the lower installed unit, right vertical mullion 112B aligned with left 112A, click and joins, then drops down that sill 106B joins on head 106A below.

According to examples of the present specification, the organic forms 334, 316, 350 and 610 are disposed in various vertical and/or horizontal framing cavities for:

a. Managing convective air movements and thereof energy transfer reduction control;
b. In-plane alignment with other thermal separating elements (e.g., insulating glass units) between exterior and interior environments;
c. Accepting, and dynamically accommodating building structure and curtain wall movements, dimension tolerances, and materials' expansion and contraction; and
d. Managing excessive water for drainage to exit the rain-screen cavities.

The organic forms 334, 316, and 610 can be fabricated from extruded foams. In one example, the organic forms are made from GPS foam material sold under the brand name Neopor BASF. GPS is a closed-cell graphite polystyrene that integrates high-purity graphite particles, providing approximately 20% improvement over traditional EPS in resisting energy transfer by reflecting radiant heat. Polystyrene as such, and specifically EPS has been occasionally used by glazing/framing manufacturers in filling some perimeter window cavities. It has been discovered that GPS is suitable for use in curtain wall construction. GPS is produced in various densities suiting the different employed cavities. Controlling cold air movement in required installation cavities, and reducing convective heat-loss are some of the objectives. GPS is durable and dimensionally stable, has constant long-term thermal resistance, maintains its R-value performance at its original level and does not deteriorate over time or the deterioration is less. GPS is hydrophobic and there is less challenges with using the material under hydrostatic pressure. Moreover, it is resource-efficient, using up to 30% less material than other rigid foam insulation to achieve the same R-value, saving on building materials and installation labour. Additional advantages will be apparent to those of ordinary skill in the art. The present specification is not limited to the use of extruded foam or GPS. Other materials are suitable including polyisocyanurate, EPS, XPS, aerogel insulation materials, and the like.

The shaping of the organic forms is designed to provide increased bulk within the cavities to reduce or inhibit heat transfer by convection and to reduce the radiation across the spaces, while at the same time to permit compression or flexing of the material to accommodate building movement at expansion joints particularly for large structures. Curtain wall systems are designed to adjust to structural movement.

Examples of the present specification were tested by running a simulation of thermal values for frame sections based on the regulations of the standard ISO 10077-1:2010 and 10077-2:2012. The thermal conductivities of the materials under test refer to relevant standards, technical approvals or have been determined by measured values according to ISO 10077-2:2012, Chapter 5.1. For modeling and thermal analysis, the software Flixo 7 of Infomind was used with the above cited ISO standards for materials and boundary conditions and approval of PHACTOR II compliance. Using the materials' assemblies, Isotherms and Infrared plots for vertical section at transom among others, simulations demonstrate low thermal transmission rates and highest interior surface temperatures. The skilled reader will appreciate that obtained values are illustrative and are not intended to restrict the scope of the present specification.

A unitized curtain wall system includes pre-assembled, pre-glazed aluminum framed curtain wall units. Vertical mullion components and top and bottom horizontal rail components interconnect adjacent curtain wall panels. The curtain wall units are suspended from one or more upper anchors installed on an upper floor slab. The bottom horizontal rail components are engaged with top horizontal rail components of adjacent, lower curtain wall units forming a continuous beam scheme for vertical mullion components and configured to accept lateral loads. The gravity loads of curtain wall units are supported by one or more floor anchors. Organic shaped insulating forms are disposed laterally between top and bottom horizontal rail components of adjacent curtain wall panels. The forms are compressible to permit flexing vertical movement of the curtain wall units while reducing air movement in a horizontal cavity formed between the top and bottom horizontal rail components forming a stack joint.

Implementations may include one or more of the following features.

This specification provides a unitized curtain wall system that includes pre-assembled, pre-glazed aluminum framed curtain wall units. Vertical mullion components and top and bottom horizontal rail components interconnect adjacent curtain wall panels. The curtain wall units are suspended from one or more upper anchors installed on an upper floor slab. The bottom horizontal rail components are engaged with top horizontal rail components of adjacent, lower curtain wall units forming a continuous beam scheme for vertical mullion components and configured to accept lateral loads. The gravity loads of curtain wall units are supported by one or more floor anchors. Organic shaped insulating forms are disposed laterally between top and bottom horizontal rail components of adjacent curtain wall panels. The forms are compressible to permit flexing vertical movement of the curtain wall units while reducing air movement in a horizontal cavity formed between the top and bottom horizontal rail components forming a stack joint.

Examples of the present specification provide an organic shaped insulating form for use in a unitized curtain wall system.

The organic shaped insulating forms can be disposed to isolate external cold elements and environmental conditions from interior warm mullion components and rail components providing thermal separation and air movement control. The organic shaped insulating forms include G-EPS foam, can be extruded cuttings, and can be finger shaped to provide bulk for thermal separation and air movement control and to permit flexing at building joints.

In one implementation, the curtain wall units have ends and further include sealing members, more specifically, rain seal gaskets, disposed at the ends to provide air and water tightness, pressure moderation, controlled environment between exteriors and rain-screen cavities, controlled water penetration, and controlled drainage.

The framed curtain wall units can be insulated with G-EPS-foam (0.031 W/(mK)).

The curtain wall units can include an in-fill material such as transparent glass, opaque glass, stone, aluminum composite, or any opaque material.

In one implementation, the curtain wall units include a glass in-fill having a thickness of 48 mm comprising 4 mm glass, 18 mm gap, 4 mm glass, 18 mm gap and 4 mm glass.

The curtain wall units can include an operable window.

The system can provide a thermal transmittance value comprising a U-factor of 0.79 W/(m2K). The system can meet cool, temperate climate Passive House Advanced phA certification performance criteria.

According to one example of the present specification, a method for installing a unitized curtain wall system of claim includes the steps of: hoisting the curtain wall unit to a location at a building structure, aligning first vertical mullion components of the curtain wall unit to second vertical mullion components of an already installed adjacent curtain wall unit, aligning a bottom horizontal rail component of the curtain wall unit to a top horizontal rail component of an already installed lower curtain wall unit so that the insulated forms are positioned within a horizontal cavity formed between the top and bottom horizontal rail components, and anchoring the curtain wall unit to the building structure.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A unitized curtain wall system comprising:

pre-assembled, pre-glazed aluminum framed curtain wall units having sides, a top, and a bottom, the curtain wall units framing glass units and being adapted to bear gravity loads and lateral loads and provide thermal separation between a building interior and a building exterior, the curtain wall units comprising vertical mullion components on the sides of the curtain wall units, and top and bottom horizontal rail components on the tops and bottoms of the curtain wall units, respectively, the vertical mullion components and the top and bottom horizontal rail components fastened together, the system comprising interconnected adjacent curtain wall units;

the vertical mullion components of the curtain wall units secured to and suspended from one or more upper anchors installed on an upper floor slab;

the bottom horizontal rail components engaged with top horizontal rail components of adjacent, lower curtain wall units;

foam insulation disposed in one or more cavities between adjacent vertical mullion components and horizontal rail components, the foam insulation being compressible to permit flexing vertical movement of the curtain wall units and being shaped to reduce convective air movement in the one or more cavities;

glazing gaskets disposed at one or more of the sides, the top, and the bottom of the curtain wall units to provide air and water tightness; and rain screen gaskets disposed at one or more of the sides, the top, and the bottom of the curtain wall units to provide pressure moderation, controlled environment between exteriors and rain-screen cavities, controlled water penetration, and controlled drainage.

2. The unitized curtain wall system of claim 1 wherein the foam insulation isolates external cold elements and environmental conditions from interior warm mullion components and rail components providing thermal separation and air movement control.

3. The unitized curtain wall system of claim 1 wherein the foam insulation comprises G-EPS foam.

4. The unitized curtain wall system of claim 1 wherein the foam insulation comprises extruded cuttings.

5. The unitized curtain wall system of claim 1 wherein the foam insulation is finger shaped to provide bulk for thermal separation and air movement control and to permit flexing at building joints.

6. The unitized curtain wall system of claim 3 wherein the G-EPS-foam has a thermal conductivity resistance of substantially 0.031 W/(mK).

7. The unitized curtain wall system of claim 1 wherein the units comprise an in-fill material selected from one of: transparent glass, opaque glass, stone, aluminum composite, and opaque material.

8. The unitized curtain wall system of claim 1 wherein the glass units comprise a glass in-fill having a thickness of 48 mm comprising 4 mm glass, 18 mm gap, 4 mm glass, 18 mm gap and 4 mm glass.

9. The unitized curtain wall system of claim 1 wherein the curtain wall units comprise an operable window.

10. The unitized curtain wall system of claim 1 providing a thermal transmittance value comprising a U-factor of substantially 0.79 W/(m2K).

11. The unitized curtain wall system of claim 1 wherein the system meets a cool, temperate climate Passive House Advanced phA certification performance criteria.

12. A method for installing the unitized curtain wall system of claim 1 comprising the steps of:

hoisting the curtain wall unit to a location at a building structure;

aligning first vertical mullion components of the curtain wall unit to second vertical mullion components of an already installed adjacent curtain wall unit;

aligning a bottom horizontal rail component of the curtain wall unit to a top horizontal rail component of an already installed lower curtain wall unit so that the insulation foam is positioned within a horizontal cavity formed between the top and bottom horizontal rail components;

anchoring the curtain wall unit to the building structure.

13. A foam insulation for use in one or more cavities of a unitized curtain wall system, the system comprising curtain wall units having vertical mullion components and horizontal rail components, wherein the cavities are disposed between adjacent vertical mullion components and horizontal rail components.

14. The unitized curtain wall system of claim 1 further comprising a fiberglass chair positioned under glass units.

* * * * *